US005433229A

United States Patent [19]

Blair

[11] Patent Number: 5,433,229

[45] Date of Patent: Jul. 18, 1995

[54] SYSTEM FOR RECOVERING AND WASHING TUBE CLEANING PLUGS

[75] Inventor: Russell M. Blair, Westport, Conn.

[73] Assignee: Slickbar Products Corp., Seymour, Conn.

[21] Appl. No.: 223,857

[22] Filed: Apr. 6, 1994

[51] Int. Cl.[6] ..... B08B 3/04

[52] U.S. Cl. ..... 134/104.3; 134/201; 15/3.51

[58] Field of Search ..... 15/3.5, 3.51; 134/104.3, 201, 8; 115/75

[56] References Cited

U.S. PATENT DOCUMENTS

| | | | |
|---|---|---|---|
| 538,461 | 4/1895 | Noble . | |
| 614,059 | 11/1898 | Noble . | |
| 1,642,610 | 9/1927 | Ingles | 134/8 |
| 1,795,348 | 3/1931 | Schmidt | 134/8 |
| 3,707,442 | 12/1972 | Takahashi et al. | 165/95 X |
| 3,872,920 | 3/1975 | Honma et al. | 165/95 |
| 3,882,931 | 5/1975 | Kumagai . | |
| 3,919,732 | 11/1975 | Honma et al. . | |
| 4,124,065 | 11/1978 | Leitner et al. . | |
| 4,126,969 | 11/1978 | Jones . | |
| 4,135,949 | 1/1979 | Reese . | |
| 4,141,753 | 2/1979 | Creed . | |
| 4,173,806 | 11/1979 | Hammelmann . | |
| 4,275,475 | 6/1981 | Schwartz et al. . | |
| 4,314,604 | 2/1982 | Koller . | |
| 4,350,202 | 9/1982 | Schulz et al. . | |
| 4,351,387 | 9/1982 | Milia . | |
| 4,365,379 | 12/1982 | Neff . | |
| 4,385,660 | 5/1983 | Koller . | |
| 4,402,360 | 9/1983 | Baron et al. . | |
| 4,413,370 | 11/1983 | Payne et al. . | |
| 4,416,703 | 11/1983 | Scott . | |
| 4,435,285 | 3/1984 | Okouchi et al. . | |
| 4,554,965 | 11/1985 | Buchinski et al. | 165/95 |
| 4,569,097 | 2/1986 | Echols . | |
| 4,696,318 | 9/1987 | Smith . | |
| 4,984,629 | 1/1991 | Voith et al. | 15/3.51 |
| 5,069,722 | 12/1991 | Murphy . | |
| 5,176,204 | 1/1993 | Ben-Dosa | 15/3.51 |

FOREIGN PATENT DOCUMENTS

| | | | |
|---|---|---|---|
| 2406860 | 8/1975 | Germany | 134/8 |

*Primary Examiner*—Frankie L. Stinson
*Attorney, Agent, or Firm*—Ware, Fressola, Van Der Sluys & Adolphson

[57] ABSTRACT

A system for recovering and washing tube cleaning plugs includes a tube cleaning plug recovery sump disposed in a flowing stream of water and a tube washing subsystem located on-shore. The tube cleaning plugs are recovered from the water and conveyed to the tube washing subsystem where they are washed. After washing, the tube cleaning plugs can be recycled for further use.

31 Claims, 3 Drawing Sheets

SYSTEM FOR RECOVERING AND WASHING TUBE CLEANING PLUGS

BACKGROUND OF THE INVENTION

The present invention generally relates to a system for recovering and washing tube cleaning plugs and, in particular, relates to one such system including means for maintaining a tube cleaning plug recovery vessel at a preselected depth in the water.

The use of tube cleaning plugs for cleaning the inside of pipes is generally known frown U.S. Pat. No. 4,569,097 entitled Tube Cleaners and issued to Echols on Feb. 11, 1986. Therein recirculating tube cleaning plugs are passed through the tubes of heat exchangers. The tube cleaning plugs are sized and shaped to scrape away slime and sediment from the heat exchanger tubes. Various cleaning plug geometries as discussed.

Further, the recovery and washing of tube cleaning plugs that are discharged from the cooling water pipes of a power plant heat exchanger is known from U.S. Pat. No. 4,696,318 entitled Washing Methods And Apparatus For Heat Exchanger Tube Cleaning Plugs issued on Sep. 29, 1987 and assigned to the assignee hereof. As discussed and described therein floating tube cleaning plugs are introduced into the cooling system of the power plant heat exchanger and are propelled therethrough along with the coolant water. The tube cleaning plugs are sized to scrape away slime, sediment, and the like, from the inside of the heat exchanger condenser tubes as they pass therethrough. The tube cleaning plugs are subsequently discharged into the outflow stream of cooling water. The outflow stream is then typically discharged into a flowing body of water, such as a river, a canal or a stream. The tube cleaning plugs are carried by the flow of the current to a washing station where the tube cleaning plugs are recovered, washed and returned to the pipes of the cooling system. As described therein, the tube cleaning plugs are captured by a floating guideway including outwardly extending booms. Once captured, the tube cleaning plugs are transported to a washing zone by an endless conveyor belt.

One of the drawbacks of present tube cleaning plug recovery and washing systems is that all of the recovery and washing of the tube cleaning plugs occurs in the middle of the flowing stream, or river, of water. As a result, maintenance of the system can be difficult. Further, such systems, because the tube cleaning plugs are guided directly to the endless conveyor belt by the floating guideway, may not efficiently recover those tube cleaning plugs that are bobbing below the surface of the water.

Consequently, a system for receiving and washing tube cleaning plugs that overcomes or avoids these drawbacks is highly desirable not only to reduce maintenance expenses but to ensure recovery of substantially all of the submerged tube cleaning plugs.

SUMMARY OF THE INVENTION

Accordingly one object of the present invention is to provide a tube cleaning plugs recovery and washing system that substantially completely overcomes that above-discussed drawbacks of present tube cleaning plug recovery and washing systems.

This object is accomplished, at least in part, by providing a tube cleaning plugs recovery and washing system that includes means for maintaining a tube cleaning plug recovery vessel at a preselected depth in the water.

Other objects and advantageous of the present invention will become apparent to those skilled in the art from the following detailed description of the invention read in conjunction with the appended claims and the drawings attached hereto.

DESCRIPTION OF THE DRAWINGS

The drawings, not drawn to scale, include.

DETAILED DESCRIPTION OF THE INVENTION

Figure 1:
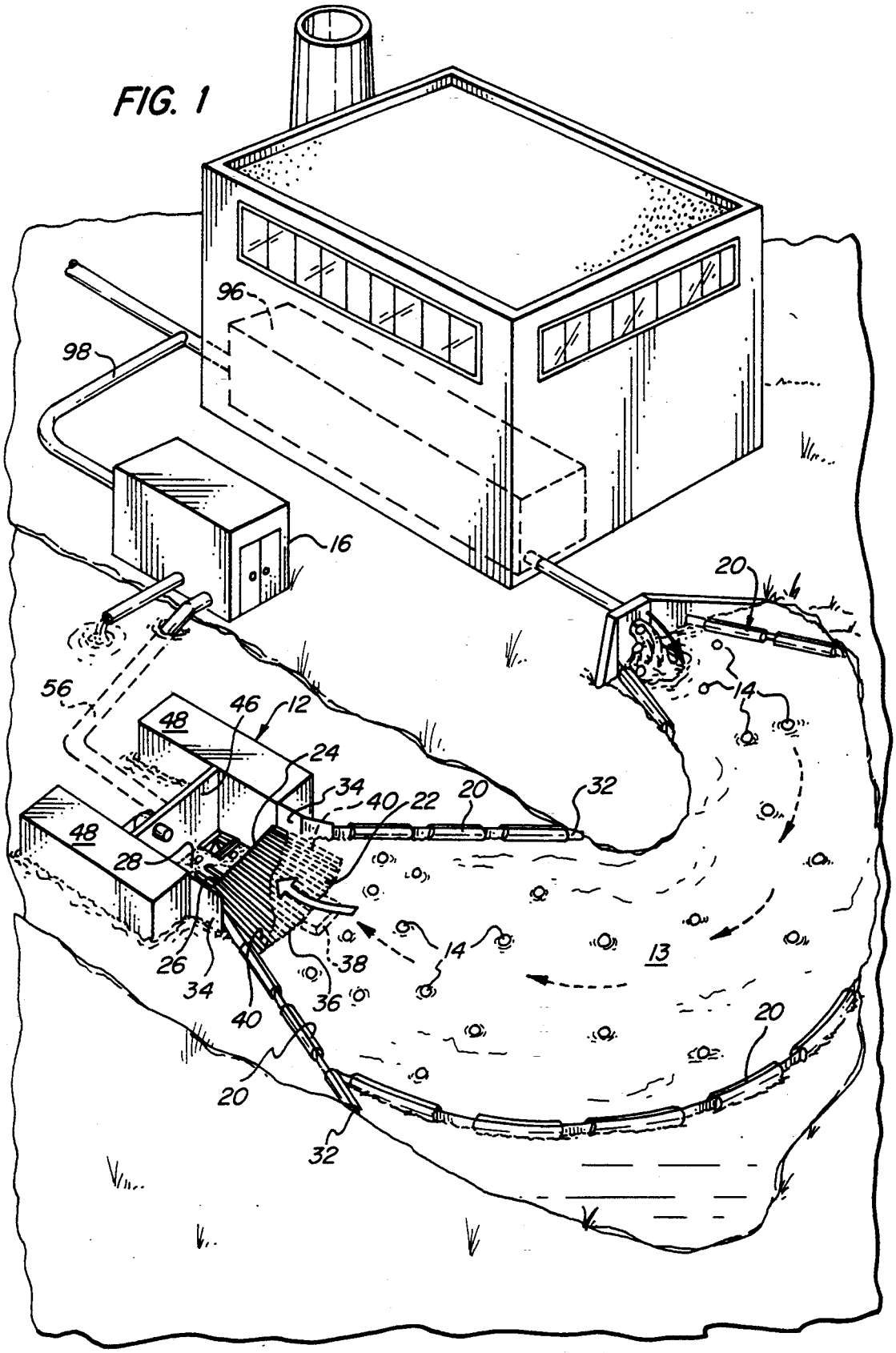
FIG. 1 which is a system diagram of a system for recovering and washing tube cleaning plugs embodying the principles of the present invention.

A system, generally indicated at 10 in FIG. 1 and embodying the principles of the present invention, includes means 12, disposed in a flowing stream of water 13, for recovering tube cleaning plugs 14 from the water, means 16, on-shore or remotely located from the means 12 for recovering tube cleaning plugs 14, for cleaning the tube cleaning plugs 14, and means 18 for conveying the recovered tube cleaning plugs 14 from the recovery means 12 to the cleaning means 16.

In one preferred embodiment, the means 12 for recovering robe cleaning plugs 14 includes a pair of partially submerged deflection booms 20 that guide the tube cleaning plugs 14 toward a submerged ramp 22 having one end 24 thereof affixed to an overflow weir entrance 26 of a floating sump 28. Preferably, the means 12 for recovering tube cleaning plugs 14 further inches a means 30, shown in FIG. 2, for providing make-up water to the sump 28 as and when needed.

Preferably, each of the partially submerged deflection booms 20 has one end 32 disposed proximate the bank of the flowing stream of water and the other end 34 thereof affixed to the recovery means 12 on the sides of the ramp 22. The booms 20 are, in one embodiment, sized so that about 10 to 12 inches thereof extends below the surface of the water. In this manner, not only are the tube cleaning plugs 14 that are floating on the surface of the water guided towards the ramp 22 but tube cleaning plugs 14 that are somewhat submerged are also captured and recovered. The booms 20, the ramp 22 and the entrance 26 of the floating sump 28 define a weir that ensures the capture of the tube cleaning plugs 14 from the flowing stream of water.

As stated, the ramp 22 is affixed at the downstream end 24 thereof to the overflow weir entrance 26 at the upstream side of the sump 28. In one preferred embodiment, the ramp 22 extends upstream away from the sump 28 and terminates at a distal end 36. Preferably, the distal end 36 of the ramp 22 also extends downwardly into the water. In one particular embodiment, the distal end 36 is provided with a float 38 by which the depth of the distal end 36 can be controlled. Alternatively, the depth of the distal end 36 of the ramp 22 can be manually adjusted and mechanically held in place. Typically, the depth of the distal end 36 will be at least equal to the depth of the booms 20 to ensure that all of the tube cleaning plugs 14 captured by the booms 20 whether they are floating or bobbing beneath the water surface are directed onto the ramp 22. In one embodiment, the ramp 22 is fabricated to allow water to drain therethrough while nonetheless allowing the tube cleaning plugs 14 carried by the current i.e., hydraulical over weir 26 to enter the floating sump 28 via the overflow weir 26. The height of the weir 26 with respect to the flowing stream of water 13 can be adjusted to regulate the rate of flow of water into the sump 28. Thus, the ramp 22 can be fabricated with a plurality of longitudinal bars 40 spaced apart by a distance that is relatively small compared to the smallest dimension of the tube cleaning plugs 14. Hence, the tube cleaning plugs 14 are carried along the ramp 22 by the current of the stream merging with the current over the weir 26 i.e., the tube cleaning plugs 14 are hydraulically carried over the weir 26, while excess water is drained off without loss of any tube cleaning plugs 14 through the openings between the longitudinal bars 40. Of course, other drainage arrangements can also by used, for example, openings that are relatively small compared to the tube cleaning plugs 14 can be formed in an otherwise solid ramp 22.

Figure 2:
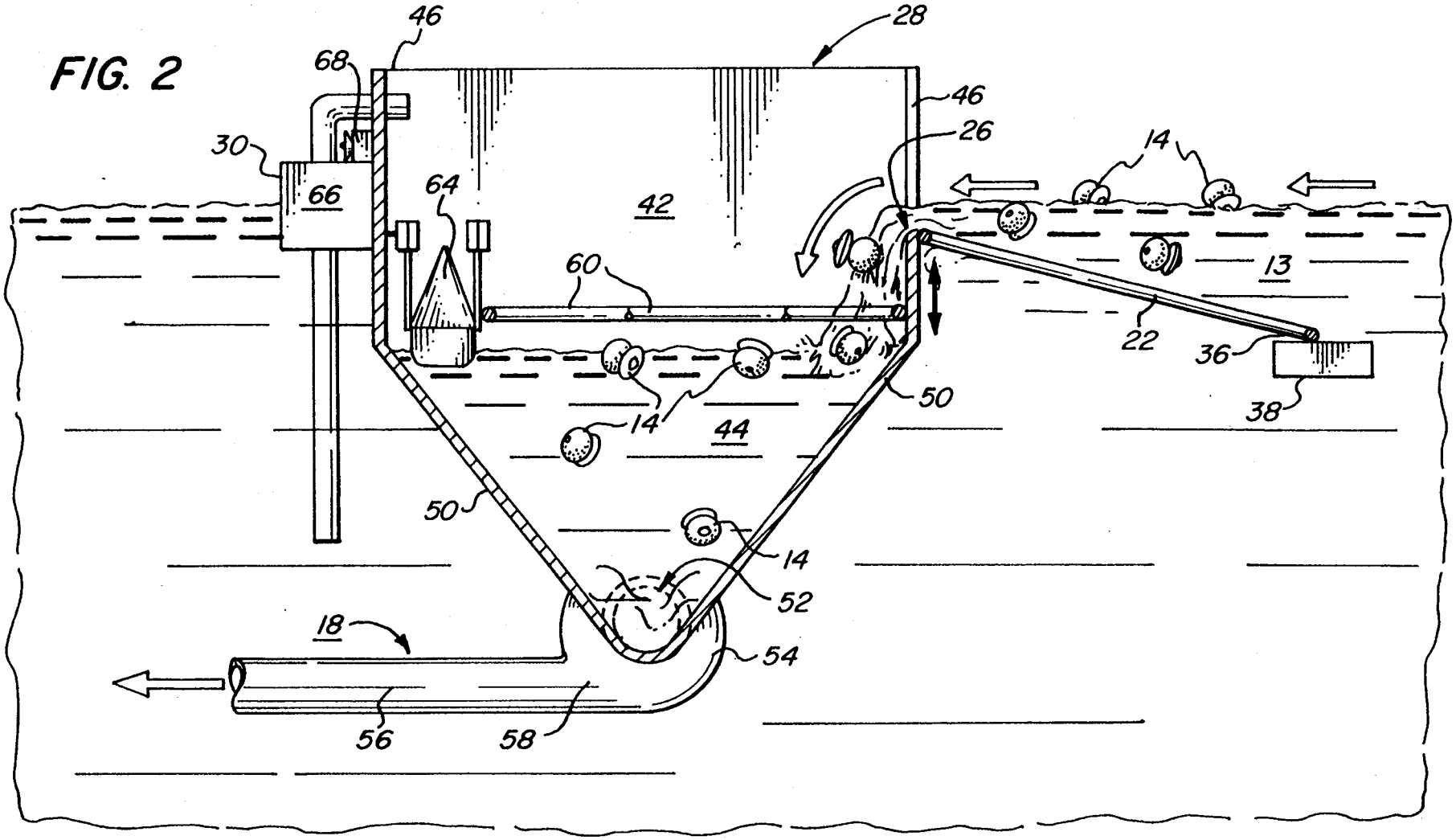
FIG. 2 is a cross-sectional view of a tube cleaning plugs recovery unit particularly useful in the system shown in FIG. 1.

In one embodiment, as shown in FIG. 2, the floating sump 28 includes an upper portion 42 and a lower portion 44. The upper portion 42 is enclosed by walls 46. The wall 46 facing upstream is provided with the sump entrance 26 having the one end 24 of the ramp 22 affixed thereto. The sump 28 includes one or more floatation devices 48 rigidly attached thereto to maintain the sump 22 on the surface of the flowing stream of water. The floatation devices 48 are sized not only to maintain the sump 28 on the surface of the water but also support ancillary equipment including the booms 20. Further, the floatation devices 48 are adjusted to maintain the entrance 26 about 2 to 3 inches below the surface of the water.

As shown in FIG. 2, the lower portion 44 of the sump 28 includes sides 50 that taper the sump 28 from the upper portion 42 to a pump entry opening 52. Hence, the tube cleaning plugs 14 that enter the sump 28 are funneled into a sump pump 54 having an inlet communicating with the pump entry opening 52. The sump pump 54 receives the recovered tube cleaning plugs 14 from the sump entry opening 52 and conveys them into a pipe 56 connected to the outlet 58 of the sump pump 54. The sump pump 54 and the pipe 56 constitute part of the means 18 for conveying the recovered tube cleaning plugs 14 from the recovery means 12 to the cleaning means 16.

To ensure a continuous flow of tube cleaning plugs 14 from the flowing stream of water 13 into the sump 28, the water level within the sump 28 is maintained at a lower level than that of the flowing stream of water 121. This differential water level can, in the preferred embodiment, be controlled and regulated by the sump pump 54. It will be understood that although the sump pump 54 is shown in FIG. 2 as being proximate the sump 28, it may also, as shown at 54A in FIG. 3, be disposed on-shore proximate the washing means 16.

In one preferred embodiment, the sump 28 is provided with a coarse filter 60 to protect the sump pump 54 from damage due to large pieces of debris. In one particular embodiment, the coarse filter 60 includes a plurality of rigid bars, or rods, disposed above the sump entry opening 52. In one arrangement, the coarse filter 60 is disposed at the intersection of the upper portion 4:1 and the lower portion 44.

Since the sump pump 54 could be readily damaged if the sump 28 were to be pumped dry, for example, if the ramp :1:1 and/or the sump 28 became clogged, the sump 28 is also preferably provided with the means 30 for introducing make-up water into the sump 28. Typically, the means 30 can include a float valve 64 that turns on a make-up water pump 66 in the event that the sump :18 becomes dry. Although such a means 30 would not unclog the sump 28 it would prevent the sump pump 54 from damage resulting from dry pumping. Hence, an alarm 68 can also be connected to the float valve 64 so that when the sump 28 becomes dry and make-up water is introduced notice will be provided and the clog can be removed.

Figure 3:
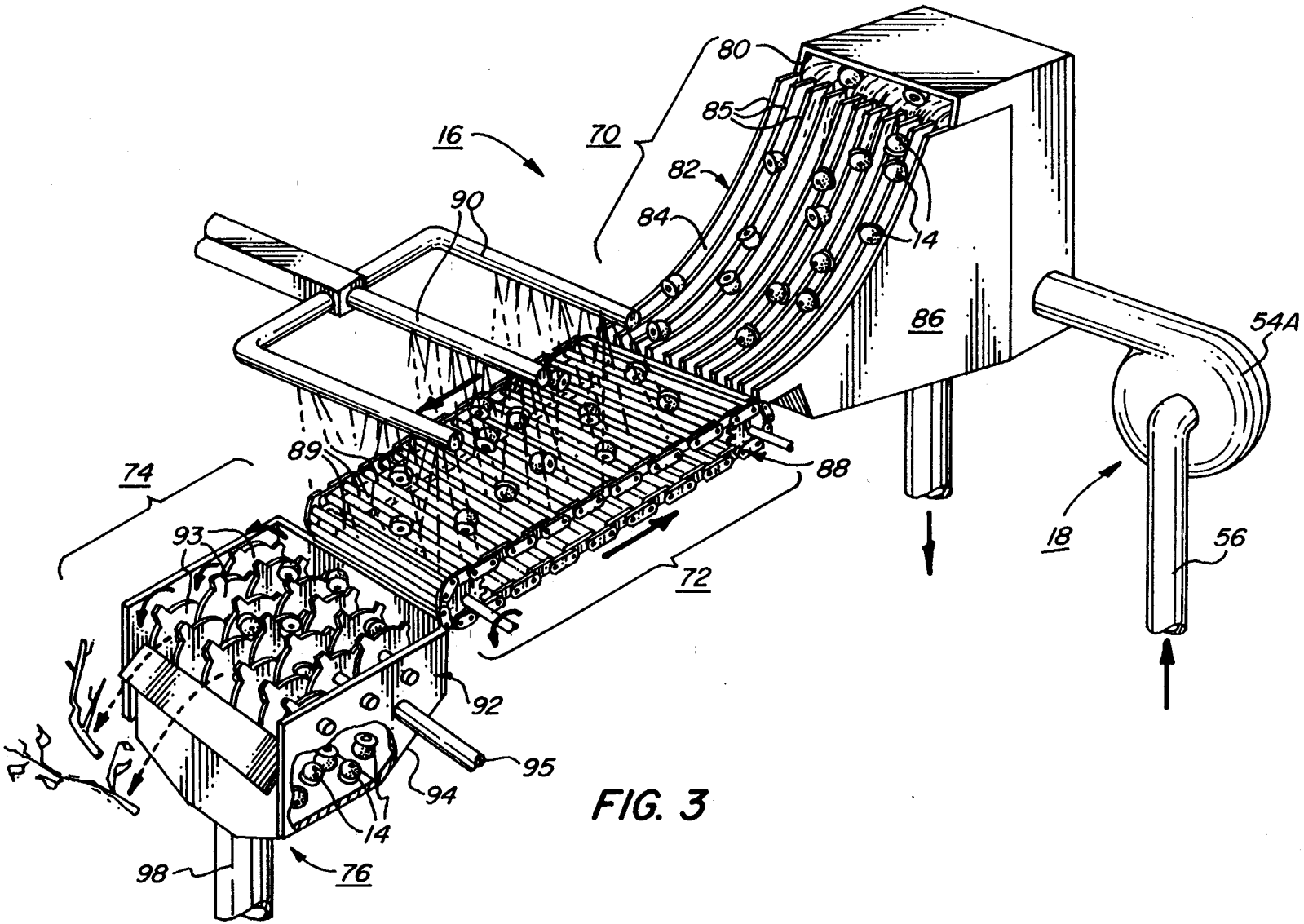
FIG. 3 is a perspective view of a tube cleaning plug washing unit particularly useful in the system shown in FIG. 1.

In the preferred embodiment, shown in FIG. 3, the means 16 for washing the recovered tube cleaning plugs 14 includes a screen section 70, a spray section 72, a debris separation section 74, and a collection section 76. The means 16 for washing the recovered tube cleaning plugs 14 is located on-shore or receives the recovered tube cleaning plugs 14 from the pipe 56 extending between the outlet 58 of the sump pump 54 and the inlet 78 of the screen section 70.

Referring to FIG. 3, the tube cleaning plugs 14 are received into the screen section 70 at the inlet 78 thereof. The tube cleaning plugs 14 are carried to the top 80 of a slide 82 by the force of the sump pump 54. The tube cleaning plugs 14, along with the water carrying them, are then passed over a screen 84. Preferably, the screen 84 is downwardly sloping so that the tube cleaning plugs 14 are carried by gravity. The screen 84 can, for example, include a series of parallel fins or rods 85, or a bar screen, or the like, that separates the water draining from the tube cleaning plugs 14. In one particular embodiment, the water falls through the screen 84 into a catch basin 86 and is returned to the flowing stream of water. Preferably, the water is gravity returned although a pump can be provided in the catch basin 86 if desired or needed. The tube cleaning plugs 14 fall down the screen 84 into the spray section 72.

Upon leaving the screen section 70 the tube cleaning plugs 14 fall onto an endless conveyor belt 88 to be carried to the debris separation section 74. Preferably, the endless conveyor belt 88 is fabricated from, for example, transverse stainless steel rods 89 to prevent deterioration of the belt 88 due to the its exposure to slime and sediment. The endless conveyor belt 88 could be fabricated from other materials as well. As the tube cleaning plugs 14 are conveyed from the screen section 70 to the debris separation section 74 they are subjected to a water spray from a plurality of water sprayers 90 disposed along the spray section 72. The number of water sprayers 90 and the pressure of the water spray is adjusted to ensure the removal of debris from the tube cleaning plugs 14.

At the end of the spray section 71 the tube cleaning plugs 14 are passed into the debris separation section 74. The debris separation section 74, in one particular embodiment, includes a rotary separator 92 incorporating a plurality of rotating spaced-apart toothed disks 93 that separate and kick out the debris while the tube cleaning plugs 14 fall between disks 93. The tube cleaning plugs 14 are then collected in a hopper 94 of the collection section 76, with transport water added through inlet 95.

Subsequent to the collection of the tube cleaning plugs 14, the tube cleaning plugs 14 are recycled into, for example, a heat exchanger system 96. As shown in FIG. 1, the tube cleaning plugs 14 can be directly conveyed by a connecting pipe 98 from the washing means 16 to the cooling water added to heat exchanger system 96. Alternatively, the tube cleaning plugs 14 can be collected at the collecting section 76 and manually reinserted into the heat exchanger system 96.

Advantageously, as can be understood from the above description, the system 10 for recovering and washing tube cleaning plugs 14 allows for recovery of substantially all of the tube cleaning plugs 14 from the flowing stream of water even if they are somewhat submerged. Further, because the means 16 for washing the tube cleaning plugs 14 is located on-shore, the maintenance thereof is easier and less expensive than previous systems.

Although the present invention has been described and discussed with respect to one or more specific embodiments, it will be understood that other arrangements or configurations can also be implemented which do not depart from the spirit and scope of the present invention. Hence, the present invention is deemed limited only by the appended claims and the reasonable interpretation thereof.

What is claimed is:

1. A system for recovering and washing tube cleaning plugs, said system comprising:

means for recovering said tube cleaning plugs from a flowing stream of water, said recovery means being disposed in said flowing stream of water, said recovery means including a floating sump having an upper portion and a lower portion, and a coarse filter disposed between said upper portion and said lower portion of said floating sump;

means for conveying said tube cleaning plugs from said recovery means to a washing station; and means at said washing station for washing said tube cleaning plugs, said washing means being located on-shore or remote from said recovery means.

2. The system as claimed in claim 1 wherein said recovering means includes:

a pair of partially submerged, outwardly extending booms, said booms having ends thereof proximate opposite banks of said flowing stream of water and other ends thereof affixed to an entrance to a floating sump;

a submerged ramp, said ramp having one end thereof affixed to said entrance of said floating sump and the other end thereof extending into and beneath the surface of said flowing stream of water.

3. The system as claimed in claim 2 wherein said floating sump includes an upper portion and a lower portion, said upper portion being defined by a plurality of walls and said lower portion being defined by a plurality of tapered walls extending from said upper portion to a sump pump entrance.

4. The system as claimed in claim 2 wherein said submerged ramp includes means for allowing water to drain therethrough.

5. The system as claimed in claim 4 wherein said means for allowing water to drain through said ramp includes a plurality of longitudinal bars.

6. The system as claimed in claim 5 wherein said longitudinal bars are spaced apart by a distance that is relatively small compared to the smallest dimension of said tube cleaning plugs.

7. The system as claimed in claim 1 wherein said washing means includes:

a screen section, said screen section receiving said tube cleaning plugs from said conveying means, said screen section including means for separating said tube cleaning plugs from water from said conveying means;

a spray section, said spray section receiving said tube cleaning plugs from said screen section, said spray section including a plurality of water sprayers; and a debris separation section, said debris separation section being disposed to receive said tube cleaning plugs from said spray section, said debris separation section including means for separating debris from said tube cleaning plugs.

8. The system as claimed in claim 7, further comprising:

means for collecting said tube cleaning plugs from said debris separation section.

9. The system as claimed in claim 7 wherein said screen section includes a screen over which said tube cleaning plugs are passed by gravity such that water from said conveying means passes through said screen into a catch basin.

10. The system as claimed in claim 7 wherein said spray section includes an endless conveyor belt, said endless conveyor belt being disposed to receive said tube cleaning plugs from said screen section, said endless conveyor belt being disposed such that said tube cleaning plugs thereon are exposed to said water from said water sprayers.

11. The system as claimed in claim 7 wherein said debris separation section is disposed to receive said tube cleaning plugs from said spray section and includes a plurality of rotating spaced-apart spokes, said spokes being disposed to separate debris from said tube cleaning plugs.

12. The system as claimed in claim 1 wherein said conveying means includes a sump pump and a pipe, said conveying means extending between said recovery means and said washing means.

13. The system as claimed in claim 12 wherein said sump pump is disposed proximate said recovery means.

14. The system as claimed in claim 12 wherein said sump pump is disposed proximate said washing means.

15. A system for recovering and washing tube cleaning plugs, said system comprising:

means for recovering said tube cleaning plugs from a flowing stream of water, said recovery means being disposed in said flowing stream of water;

means for conveying said tube cleaning plugs from said recovery means to a washing station; and means at said washing station for washing said tube cleaning plugs, said washing means being located on-shore or remote from said recovery means, said washing means including a screen section, said screen section receiving said tube cleaning plugs for said conveying means, said screen section including means for separating said tube cleaning plugs form water from said conveying means, a spray section, said spray section receiving said tube cleaning plugs from said screen section, said spray section including a plurality of water sprayers, and a debris separation section, said debris separation section being disposed to receive said tube cleaning plugs from said spray section, said debris separation section including means for separating debris from said tube cleaning plugs.

16. The system as claimed in claim 15, further comprising:

means for collecting said tube cleaning plugs from said debris separation section.

17. The system as claimed in claim 15 wherein said screen section includes a screen over which said tube cleaning plugs are passed by gravity such that water from said conveying means passes through said screen into a catch basin.

18. The system as claimed in claim 15 wherein said spray section includes an endless conveyor belt, said endless conveyor belt being disposed to receive said tube cleaning plugs from said screen section, said endless conveyor belt being disposed such that said tube cleaning plugs thereon are exposed to said water from said water sprayers.

19. The system as claimed in claim 15 wherein said debris separation section is disposed to receive said tube cleaning plugs from said spray section and includes a plurality of rotating spaced-apart spokes, said spokes being disposed to separate debris from said tube cleaning plugs.

20. A system for recovering tube cleaning plugs, said system comprising:

means for hydraulically recovering said tube cleaning plugs from a flowing stream of water, said hydraulic recovery means being disposed in said flowing stream of water, and including a weir via which said tube cleaning plugs enter a sump, said sump entrance being disposed below the surface of said flowing stream of water.

21. The system as claimed in claim 20 further comprising:

means for conveying said tube cleaning plugs from said sump of said recovery means to a washing station, said washing station being remote from said recovery means.

22. The system as claimed in claim 21 further comprising:

means, at said remote washing station, for washing said tube cleaning plugs.

23. The system as claimed in claim 20 further comprising:

a pair of partially submerged, outwardly extending booms, said booms having ends thereof proximate opposite banks of said flowing stream of water and other ends thereof affixed to said weir; and a submerged ramp, said submerged ramp having one end thereof affixed to said weir and the other end thereof extending into and beneath the surface of said flowing stream of water.

24. The system as claimed in claim 23 wherein said submerged ramp includes means for allowing water to flow therethrough.

25. The system as claimed in claim 24 wherein said means includes a plurality of longitudinal bars.

26. The system as claimed in claim 25 wherein said longitudinal bars are spaced apart by a distance that is relatively small compared to the smallest dimension of said tube cleaning plugs.

27. The system as claimed in claim 20 further comprising:

means for providing make-up water to said sump.

28. The system as claimed in claim 27 wherein said make-up water provision means includes a float valve.

29. The system as claimed in claim 28 wherein said float valve controls a make-up water pump.

30. The system as claimed in claim 27 wherein said make-up water provisioning means includes a low water level alarm, said low water level alarm controlling a make-up water pump.

31. The system as claimed in claim 27 wherein said make-up water provisioning means includes a low water level alarm such that notice is provided when said means for providing make-up water requires actuation.

* * * * *

UNITED STATES PATENT AND TRADEMARK OFFICE

CERTIFICATE OF CORRECTION

PATENT NO. : 5,433,229

DATED : July 18, 1995

INVENTOR(S) : Russell M. Blair

It is certified that error appears in the above-indentified patent and that said Letters Patent is hereby corrected as shown below:

Col. 2, line 39; "further inches" should be --further includes--

Col. 3, line 56; "121." should be --13 --

Col. 3, line 6; "hydraulical" should be --hydraulically,

Col. 4, line 1; "4:1" should be --42--

Col. 4, line 5; ":1:1" should be --22--

Col. 4, line 10; ":18" should be --28--

Col. 4, line 58; "section 71" should be --section 72--

Signed and Sealed this

Fourteenth Day of November, 1995

Bruce Lehman

*Attest:*

BRUCE LEHMAN

*Attesting Officer*

*Commissioner of Patents and Trademarks*